US008944883B2

(12) United States Patent
Kordonski

(10) Patent No.: US 8,944,883 B2
(45) Date of Patent: Feb. 3, 2015

(54) SYSTEM FOR MAGNETORHEOLOGICAL FINISHING OF A SUBSTRATE

(75) Inventor: William Kordonski, Webster, NY (US)

(73) Assignee: QED Technologies International, Inc., Aurora, IL (US)

( * ) Notice: Subject to any disclaimer, the term of this patent is extended or adjusted under 35 U.S.C. 154(b) by 732 days.

(21) Appl. No.: 13/254,640

(22) PCT Filed: Mar. 2, 2010

(86) PCT No.: PCT/US2010/025931

§ 371 (c)(1),
(2), (4) Date: Sep. 2, 2011

(87) PCT Pub. No.: WO2010/101925

PCT Pub. Date: Sep. 10, 2010

(65) Prior Publication Data

US 2011/0312248 A1 Dec. 22, 2011

Related U.S. Application Data

(60) Provisional application No. 61/158,021, filed on Mar. 6, 2009.

(51) Int. Cl.

| | |
|---|---|
| ***B24B 49/00*** | (2012.01) |
| ***B24B 51/00*** | (2006.01) |
| ***B24B 1/00*** | (2006.01) |
| ***B24B 31/10*** | (2006.01) |
| ***B24B 31/112*** | (2006.01) |

(52) U.S. Cl.

CPC ..... *B24B 1/005* (2013.01); *B24B 31/102* (2013.01); *B24B 31/112* (2013.01)

USPC ..... 451/5; 451/9; 451/109; 451/113

(58) Field of Classification Search

CPC ..... H02K 1/02; H02K 1/06; H01F 1/00; H01F 7/0273; H01F 7/02; H01F 1/447; B24B 1/005; B24B 31/102

USPC ..... 335/306, 297; 451/5, 8, 9, 10, 11, 64, 451/178, 113, 109

See application file for complete search history.

(56) References Cited

U.S. PATENT DOCUMENTS

| | | | | |
|---|---|---|---|---|
| 5,449,313 | A * | 9/1995 | Kordonsky et al. | 451/35 |
| 5,616,066 | A * | 4/1997 | Jacobs et al. | 451/36 |
| 5,795,212 | A * | 8/1998 | Jacobs et al. | 451/36 |
| 5,951,369 | A * | 9/1999 | Kordonski et al. | 451/5 |
| 7,959,490 | B2 * | 6/2011 | Sutton | 451/5 |
| 8,613,640 | B2 * | 12/2013 | Kordonski et al. | 451/8 |
| 2002/0042244 | A1 * | 4/2002 | Trommer | 451/41 |
| 2002/0102928 | A1 * | 8/2002 | Kordonski et al. | 451/64 |
| 2014/0152409 | A1 * | 6/2014 | Rotem | 335/306 |

* cited by examiner

*Primary Examiner* — Timothy V Eley
(74) *Attorney, Agent, or Firm* — Thomas E Omholt; Robert Brown; Arlene Hornilla

(57) ABSTRACT

A system for magnetorheological finishing of a substrate. A spherical wheel meant for carrying a magnetorheological finishing fluid houses a variable-field permanent magnet system having north and south iron pole pieces separated by primary and secondary gaps with a cylindrical cavity bored through the center. A cylindrical permanent magnet magnetized normal to the cylinder axis is rotatably disposed in the cavity. An actuator allows rotation of the permanent magnet to any angle, which rotation changes the distribution of flux in the magnetic circuit through the pole pieces. Thus, one can control field intensity in the gaps by positioning the permanent magnet at whatever angle provides the required field strength. Because the field also passes above the pole pieces, defining a fringing field outside the wheel surface, the variable field extends through a layer of MR fluid on the wheel, thus varying the stiffness of the MR fluid as may be desired for finishing control.

9 Claims, 7 Drawing Sheets

SYSTEM FOR MAGNETORHEOLOGICAL FINISHING OF A SUBSTRATE

CROSS-REFERENCE TO RELATED APPLICATIONS

This application claims the benefit of U.S. Provisional Application for Patent Ser. No. 61/158,021, filed on Mar. 6, 2009, which is incorporated herein by reference.

TECHNICAL FIELD

The present invention relates to systems for slurry-based abrasive finishing and polishing of substrates, and particularly, to such systems employing magnetorheological fluids and magnets adjacent to a spherical carrier wheel for magnetically stiffening the fluid in a work zone on the wheel; more particularly, to such systems wherein the stiffening magnets are disposed within the carrier wheel itself; and most particularly, to an improved system wherein the stiffening magnet is a variable-field permanent magnet assembly.

BACKGROUND OF THE INVENTION

Use of magnetically-stiffened magnetorheological fluids (MRF) for abrasive finishing and polishing of substrates is well known. Such fluids, containing magnetically-soft abrasive particles dispersed in a liquid carrier, exhibit magnetically-induced plastic behavior in the presence of a magnetic field. The apparent viscosity of the MRF can be magnetically increased by many orders of magnitude, such that the consistency of the MRF changes from being nearly watery to being a very stiff paste. When such a paste is directed appropriately against a substrate surface to be shaped or polished, for example, an optical element, a very high level of finishing quality, accuracy, and control can be achieved.

U.S. Pat. No. 5,951,369, issued Sep. 14, 1999 to Kordonski et al., discloses methods, fluids, and apparatus for deterministic magnetorheological finishing of substrates. This patent is referred to herein as "'369."

In a typical magnetorheological finishing system such as is disclosed in the '369 patent, a work surface comprises a vertically-oriented non-magnetic wheel having an axially-extending rim which is undercut symmetrically about a hub. Specially-shaped magnetic pole pieces are extended toward opposite sides of the wheel under the undercut rim to provide a magnetic work zone on the surface of the wheel, preferably at about the top-dead-center position. The surface of the wheel is preferably an equatorial section of a sphere.

Mounted above the work zone is a substrate receiver, such as a rotatable chuck, for extending into the work zone a substrate to be finished. The chuck is programmably manipulable in a plurality of modes of motion and is preferably controlled by a programmable controller or a computer.

MRF is extruded in a non-magnetized state from a shaping nozzle as a ribbon onto the work surface of the rotating wheel, which carries the fluid into the work zone where it becomes magnetized to a pasty consistency. In the work zone, the pasty MRF does abrasive work, known as magnetorheological polishing or finishing, on the substrate. Exiting the work zone, the fluid on the wheel becomes non-magnetized again and is scraped by a scraper from the wheel work surface for recirculation and reuse.

Fluid delivery to, and recovery from, the wheel is managed by a closed fluid delivery system such as is disclosed in the '369 reference. MRF is withdrawn from the scraper by a suction pump and sent to a tank where its temperature is measured and adjusted to aim. Recirculation from the tank to the nozzle, and hence through the work zone, at a specified flow rate may be accomplished, for example, by setting the speed of rotation of a pressurizing pump, typically a peristaltic or centrifugal pump. Because a peristaltic pump exhibits a pulsating flow, in such use a pulsation dampener is required downstream of the pump.

The rate of flow of MRF supplied to the work zone is highly controlled. An inline flowmeter is provided in the fluid recirculation system and is connected via a controller to regulate the pump.

A capillary viscometer is disposed in the fluid delivery system at the exit thereof onto the wheel surface. Output signals from the flowmeter and the viscometer are inputted to an algorithm in a computer which calculates the apparent viscosity of MRF being delivered to the wheel and controls the rate of replenishment of carrier fluid to the recirculating MRF (which loses carrier fluid by evaporation during use) in a mixing chamber ahead of the viscometer, to adjust the apparent viscosity to aim.

U.S. Pat. No. 5,616,066, issued Apr. 1, 1997 to Jacobs et al. ('066), discloses a magnetorheological finishing system comprising a permanent ring magnet having north and south soil iron ring pole pieces fixedly disposed on a non-magnetic mount within a non-magnetic drum which provides a carrier surface on its outer surface.

A serious shortcoming of the '066 system is the inability to finish concave surfaces because of the cylindrical carrier wheel surface.

A further shortcoming is that a permanent magnet provides only one value of magnetic field, and thus control of removal rate by varying the strength of the magnetic field is not possible.

A still further shortcoming is that a permanent magnetic field makes difficult the cleaning and maintaining of the system for the fluid changeover.

U.S. Pat. No. 6,506,102, issued Oct. 30, 2001 to Kordonski at al. ('102), which is hereby incorporated by reference, improves upon the '066 system and discloses a system for magnetorheological finishing which comprises a vertically oriented carrier wheel having a horizontal axis. The carrier wheel is preferably an equatorial section of a sphere, such that the carrier surface is spherical. The wheel is generally bowl-shaped, comprising a circular plate connected to rotary drive means and supporting the spherical surface which extends laterally from the plate. An electromagnet having planar north and south pole pieces is disposed within the wheel, within the envelope of the sphere, and preferably within the envelope of the spherical section comprising the wheel. The magnets extend over a central wheel angle of about 120° such that MRF is maintained in a partially stiffened state well ahead of and well beyond the work zone. A magnetic scraper removes the MRF from the wheel as the stiffening is relaxed and returns it to a conventional fluid delivery system for conditioning and re-extrusion onto the wheel. The placement of the magnets within the wheel provides unencumbered space on either side of the carrier surface such that large concave substrates, which must extend beyond the edges of the wheel surface during finishing, may be accommodated. The angular extent of the magnets causes the MRF to be retained on the wheel over an extended central angle thereof, permitting orientation and finishing in a work zone at or near the bottom dead center position of the wheel.

A benefit of the '102 system is that use of an electromagnet rather than a permanent magnet enables another control parameter, i.e., the intensity of the magnetic field, to be varied by varying the current amperage supplied to the electromagnet.

A shortcoming of the '102 system is that the increased size of an electromagnet (in comparison to an equivalent-strength permanent magnet) imposes limitations on the minimum size of the spherical wheel, and thus limits the smallest radius of curvature of concave substrates to be finished.

What is needed in the art is an MRF system having a smaller-radius spherical finishing wheel.

It is a principal object of the present invention to finish smaller-radius concavities than is heretofore possible using prior art MRF systems.

It is a further object of the invention to provide a system for magnetorheological finishing of concave substrates wherein the radius of the work piece concavity is not limited by the size of magnetic system.

It is a still further object of the invention to provide a system employing permanent magnets for magnetorheological finishing of substrates wherein the finishing may be carried out at any desired magnetic field strength.

It is a still further object of the invention to reduce maintenance cost and electrical power consumption in magnetorheological finishing.

SUMMARY OF THE INVENTION

Briefly described, an improved system for magnetorheological finishing of a substrate in accordance with the invention comprises a vertically-oriented, bowl-shaped, spherical carrier wheel having a horizontal axis. The wheel comprises a circular plate connected to a rotary drive and supporting the spherical surface which extends laterally from the plate. A variable-field permanent magnet system having north and south pole pieces is disposed within the wheel, preferably within the envelope of the spherical section defined by the wheel. The magnet pole pieces extend over a central wheel angle of about 120°. A magnetic scraper removes the MRF from the wheel. The relatively small size of the permanent magnet assembly allows use of a small-radius wheel to provide unencumbered space on either side of the carrier surface such that steep concave substrates, which must extend beyond the edges of the wheel during finishing motions, may be accommodated for finishing. The angular extent of the pole pieces causes the MRF to be retained on the wheel over an extended central angle thereof.

The principle of operation of the variable-field permanent magnet magnetic system consists in redistribution of magnetic flux generated by a permanent magnet in a magnetic circuit with primary and secondary non-magnetic gaps. The variable-field magnet system comprises two pole pieces made of a magnetically-soft material such as iron, defining a magnetic body, with a cylindrical cavity bored through the center. The iron halves are joined together at the primary and secondary gaps by a non-magnetic material such as brass, aluminum, or plastic. A cylindrical permanent magnet, formed, for example, of samarium-cobalt, neodymium-iron-boron, ceramic, or the like and magnetized normal to the cylinder axis is inserted into the cavity and an actuator is attached to allow rotation of the magnet about its longitudinal axis to any desired angle. The act of rotation changes the distribution of the magnetic flux in the magnetic circuit through the iron pole pieces; thus, one can control the field intensity in the gaps by rotating and positioning the permanent magnet at whatever angle provides the required field strength. Because the field at both gaps is also effectively passing above the pole pieces, a fringing field at the primary gap extends outside the wheel and through the layer of MR fluid on the wheel surface, thus varying the stiffness of the MR fluid as may be desired for finishing control. The size and shape of the secondary gap, which is 180° apart from the primary gap, influences the intensity of the field at the primary gap.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
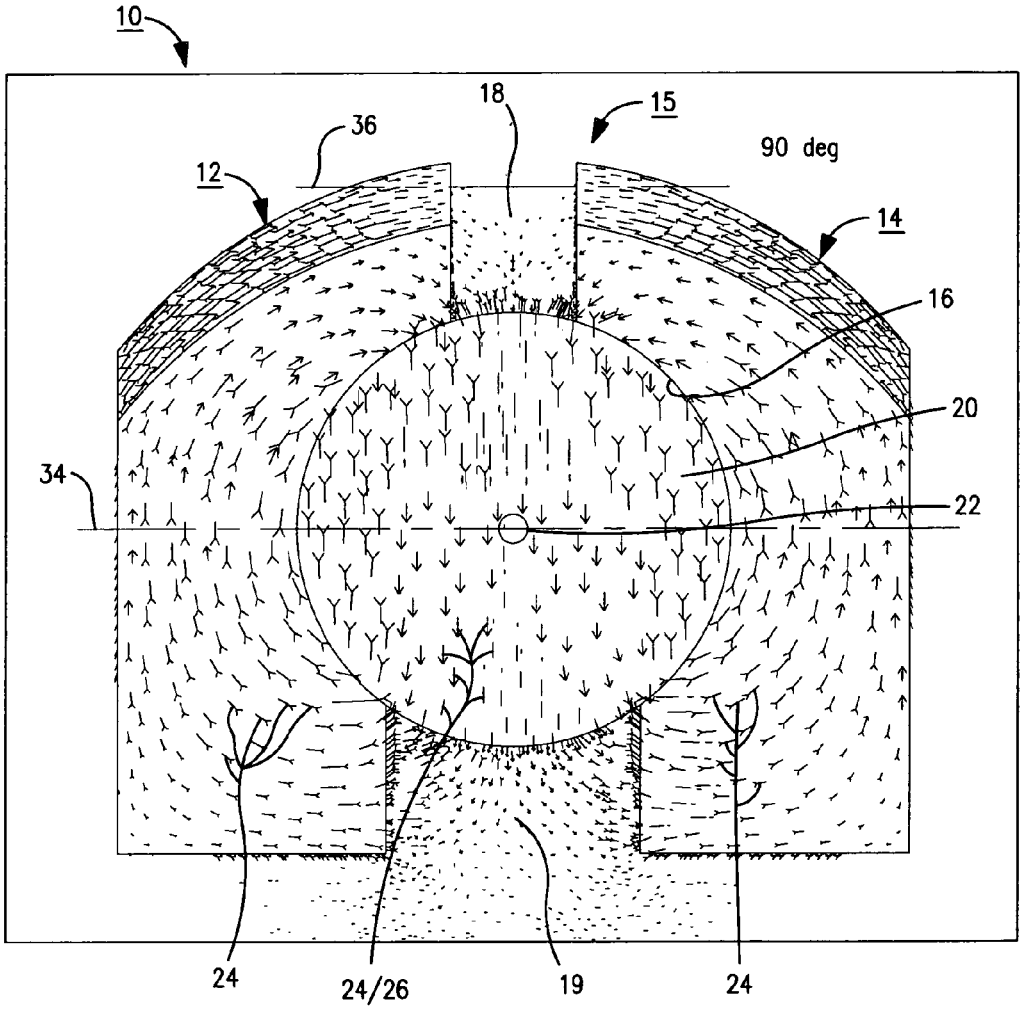
FIG. 1 is an elevational cross-sectional view generated by computerized magnetic modeling, taken through a variable-field permanent magnet system in accordance with the present invention and showing zero magnetic field at the primary and secondary gaps when the magnetic field in the cylindrical permanent magnet is oriented vertically.

Referring to FIG. 1, a variable-field permanent magnet system 10 in accordance with the present invention comprises two poles 12, 14 made of a magnetically soft material, preferably iron, defining a magnetic body 15 with a cylindrical cavity 16 bored through the center. The body halves 12, 14 are joined together by a non-magnetic material such as brass, aluminum, or plastic, defining a primary magnetic gap 18 and a secondary magnetic gap 19 between halves 12, 14. A cylindrical permanent magnet 20 magnetized normal to the cylinder axis 22 is inserted into cavity 16 and an actuator 110 (shown in FIGS. 5-7) is attached to allow rotation of magnet 20 about axis 22. Such a magnet is available from, for example, Dexter Magnetic Technologies, Elk Grove Village, Ill., USA. The act of rotation changes the distribution of the magnetic flux 24 in the magnetic circuit. When the field 26 of the permanent magnet is directed vertically as shown in FIG. 1, flux 24 is evenly distributed between two halves 12, 14 which act as opposing magnetic shunts. In this case, there is no net magnetic field in gaps 18, 19 ("off" position).

Figure 2:
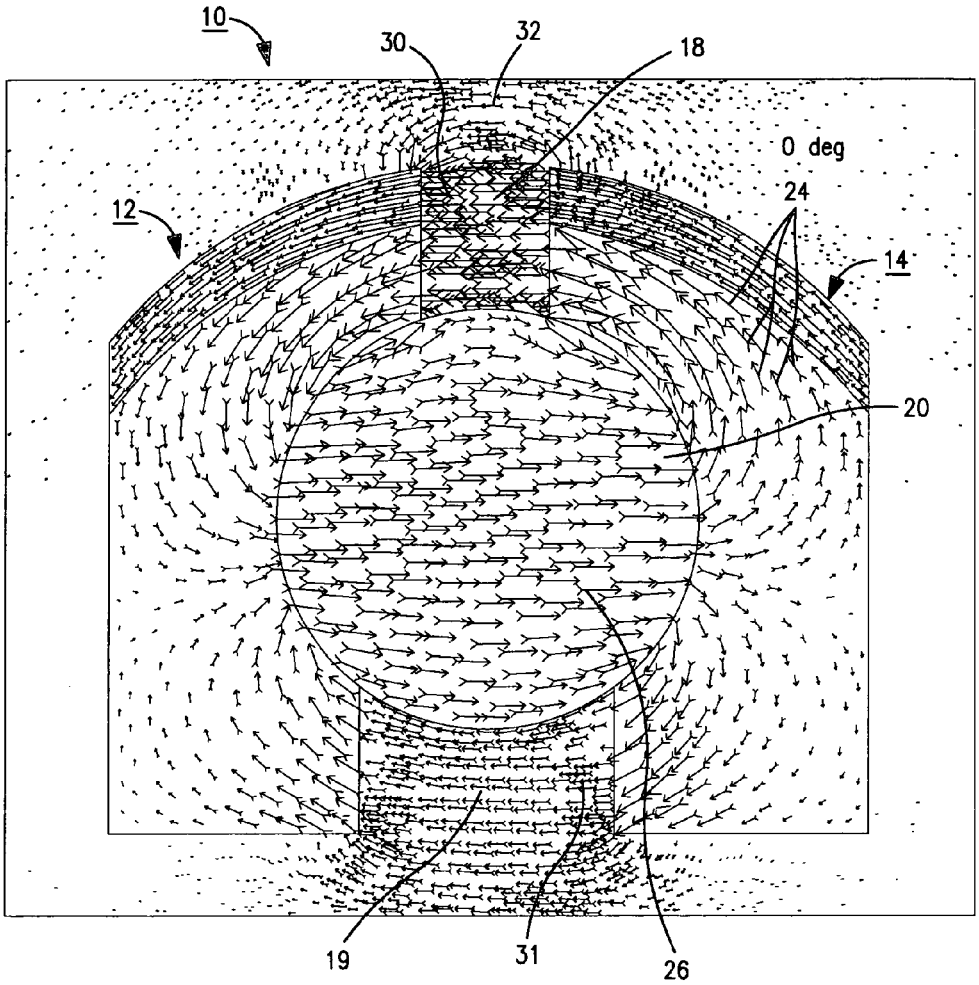
FIG. 2 is an elevational cross-sectional view like that shown in FIG. 1, showing maximum magnetic field at the gaps when the magnetic field in the cylindrical permanent magnet is oriented horizontally.

Referring now to FIG. 2, field 26 within permanent magnet 20 is directed horizontally by rotating magnet 20 within cavity 16 to a new position 90° from the position shown in FIG. 1, causing the flux 24 now to traverse gaps 18, 19 between the pole pieces 12, 14. It is seen that this position of magnet 20 produces the maximum field strength in gaps 18, 19 ("max" position).

Figure 3:
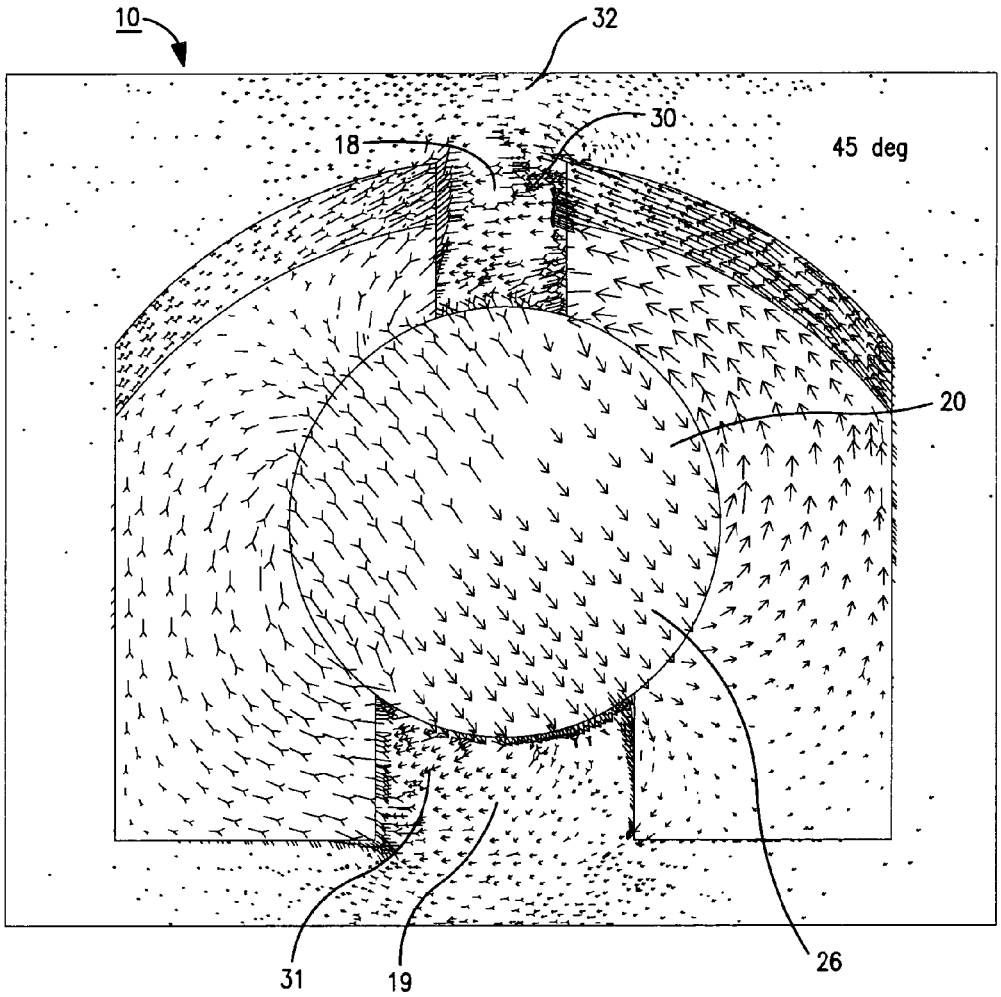
FIG. 3 is an elevational cross-sectional view like that shown in FIGS. 1 and 2, showing an intermediate-strength magnetic field at the gaps when the magnetic field in the cylindrical permanent magnet is oriented at 45°.

Referring now to FIG. 3, an exemplary intermediate rotational position of permanent magnet 20 (field angle=45°) results in intermediate field strengths 30, 31 which depend on the angle at which the magnetic field 26 is oriented. Thus, one can control intensity of the fields 30, 31 in gaps 18, 19, respectively, by rotating and positioning permanent magnet 20 at whatever angle provides the required strength of primary field 30.

Because field 30 is also effectively passing above the pole pieces 12, 14 (fringing field 32), the variable field 30 extends through a layer of MR fluid 112 on the carrier wheel (not shown but visible in FIGS. 5-7), thus controllably varying the stiffness of the MR fluid as may be desired for controlling the rate of finishing.

Note that the geometry (size and shape) of secondary gap 19 affects the magnetic field 30 at primary gap 18 and thus is an important parameter in creating a desired field intensity at primary gap 18. Preferably, the working width of secondary gap 19 is equal to or greater than the width of primary gap 18.

Figure 4:
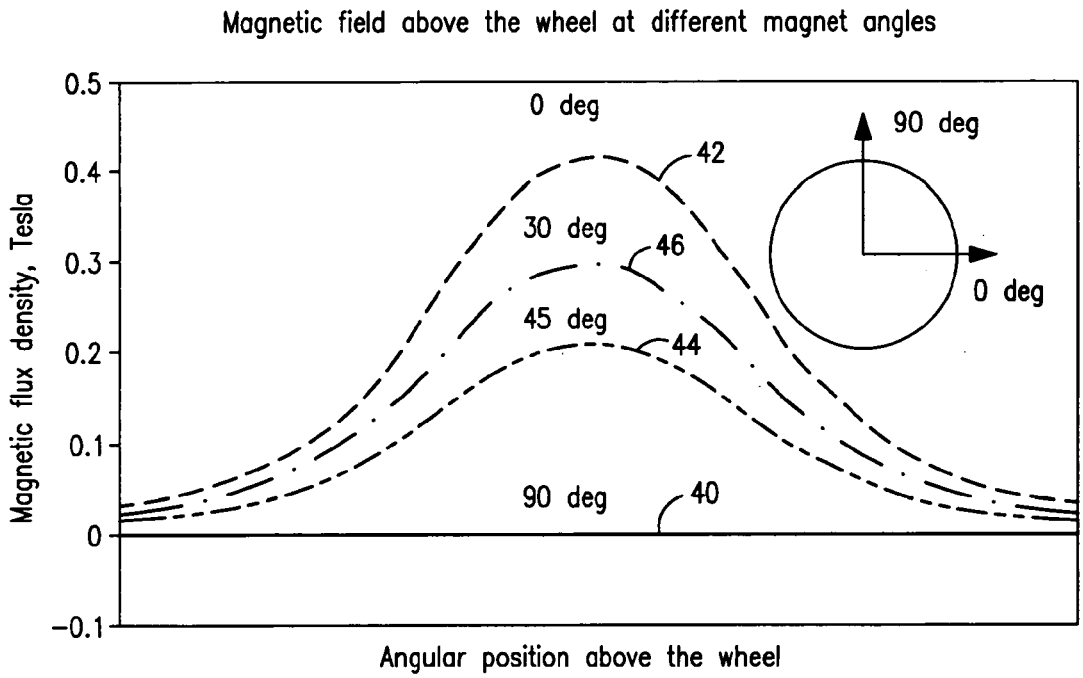
FIG. 4 is a graph showing magnetic flux intensity above the wheel at the primary gap for various cylindrical magnet orientations as a function of angular position above the finishing wheel.

Referring to FIG. 4, representative curves of magnetic intensity along the carrier wheel circumference are shown for various angles of field 26 expressed as angles departing from a plane 34 containing axis 22 and parallel to a plane 36 traversing gap 18, as shown in FIG. 1). Thus curve 40 represents the 90° orientation in FIG. 1; curve 42, the 0° orientation in FIG. 2; curve 44, the 45° orientation in FIG. 3; and curve 46, a 30° orientation.

Figure 5:
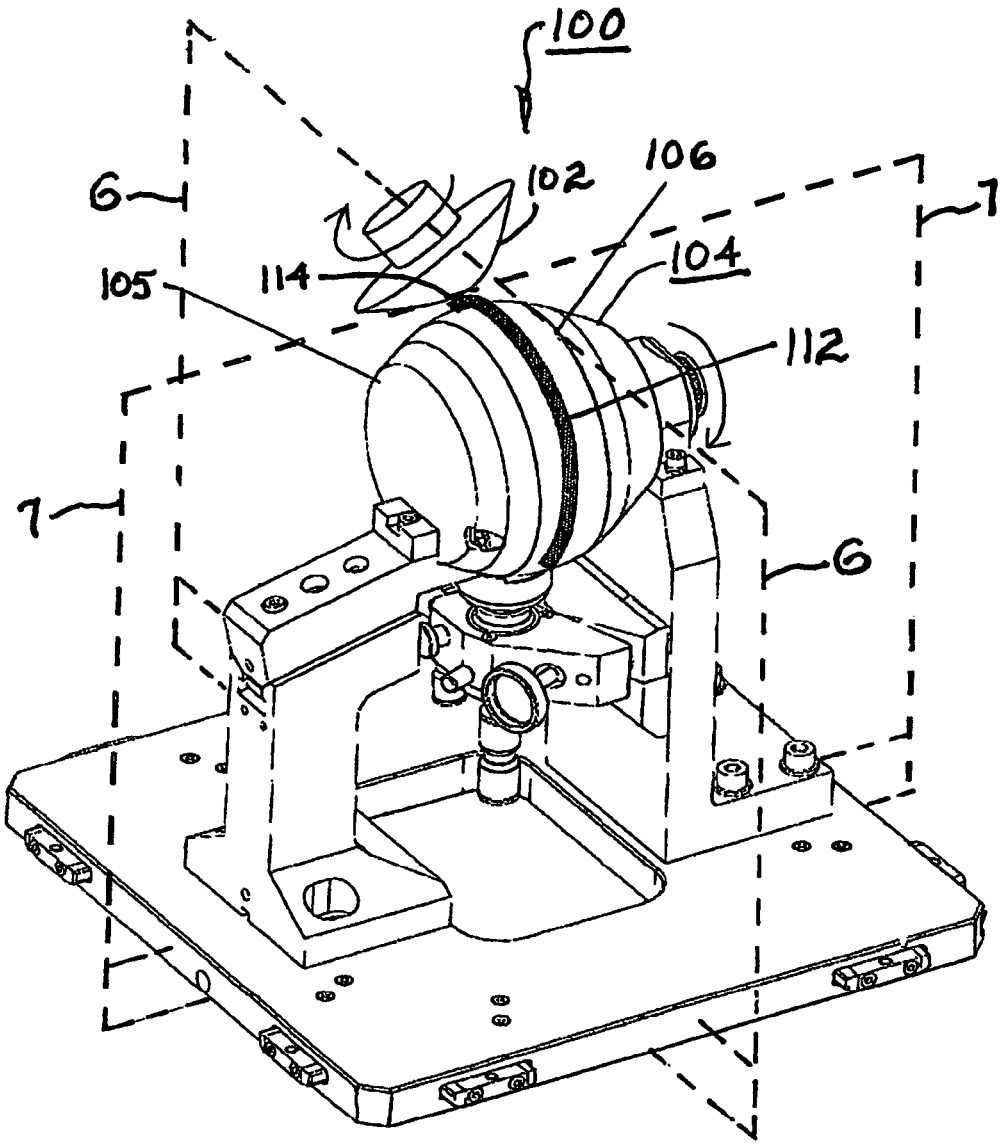
FIG. 5 is an isometric view of an MRF apparatus in accordance with the present invention.
Figure 6:
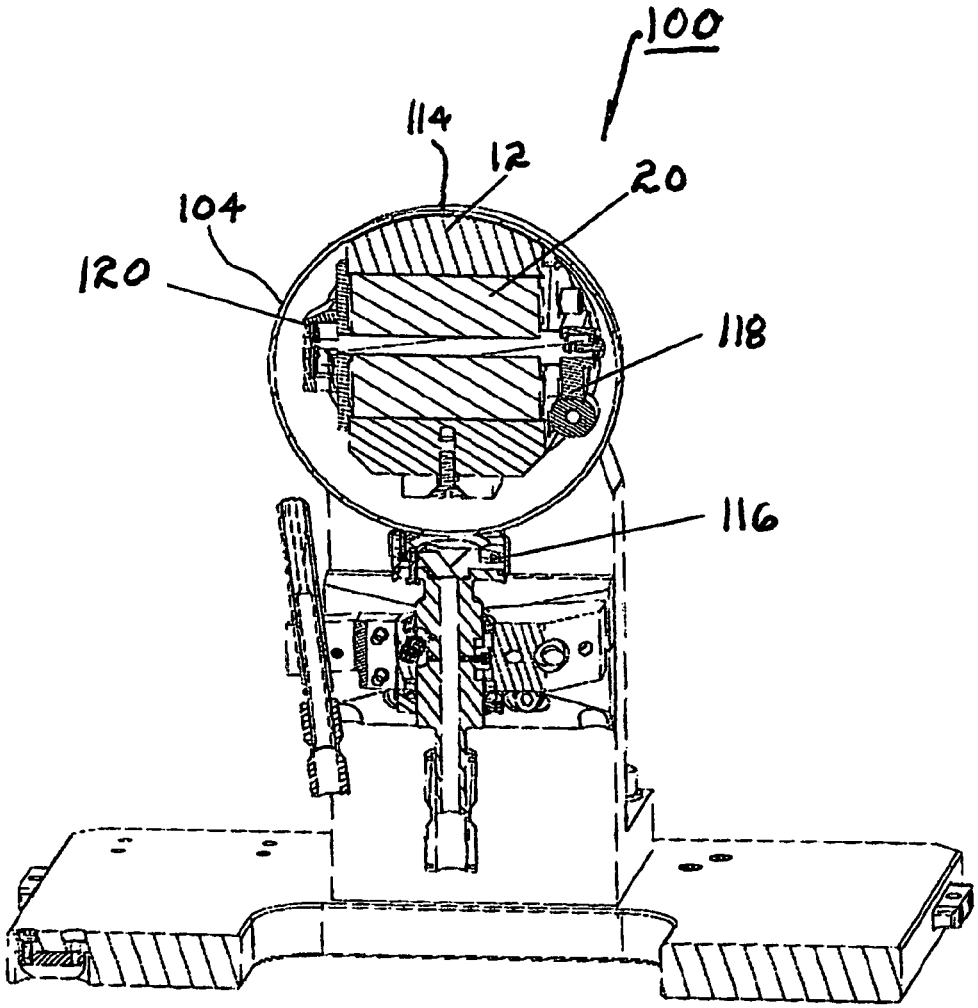
FIG. 6 is a cross-sectional view taken along plane 6-6 in FIG. 5.
Figure 7:
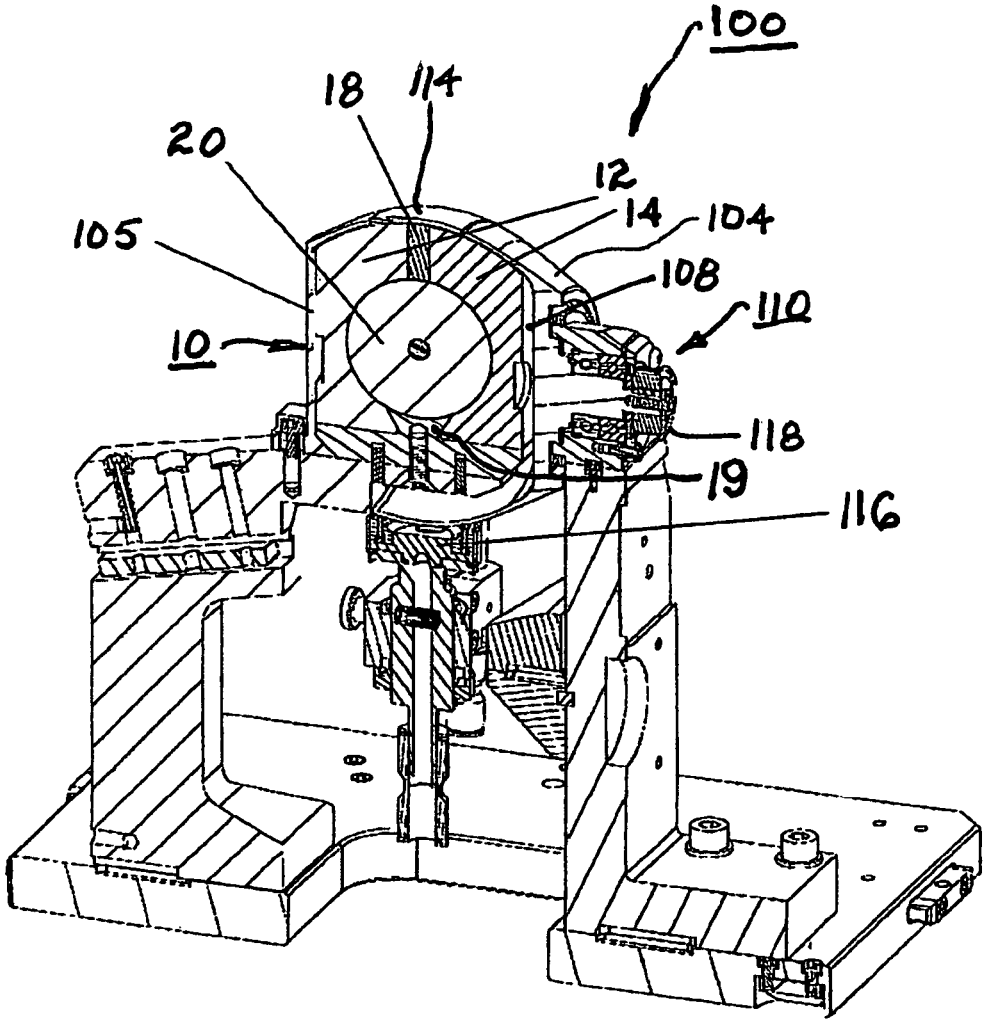
FIG. 7 is a cross-sectional view taken along plane 7-7 in FIG. 5.

Referring to FIGS. 5 through 7, an improved system 100 for magnetorheological finishing of a substrate 102 in accordance with the present invention comprises a vertically oriented carrier wheel 104 having a horizontal axis. Carrier wheel 104 is preferably an equatorial section of a sphere, such that the carrier surface 106 is spherical. Wheel 104 is generally bowl-shaped, comprising a circular plate 108 connected to rotary drive means 110 and supporting spherical surface 106 which extends laterally from plate 108. A variable-field permanent magnet system 10 having north and south pole pieces 12, 14 is disposed within wheel 104, within the envelope of the sphere and preferably within the envelope of the spherical section defined by the wheel, preferably enclosed by a cover plate 105. Preferably, pole pieces 12, 14 extend over a central wheel angle of about 120°, such that magnetorheological fluid 112 is maintained in a partially stiffened state well ahead of and well beyond the fully-stiffened work zone 114. A magnetic scraper 116 removes MRF 112 from the wheel as the stiffening is relaxed and returns it to a conventional fluid delivery system (not shown) for conditioning and re-extrusion onto the wheel. The relatively small size of permanent magnet 20 allows the use of a small wheel to provide unencumbered space on either side of the carrier surface such that steep or deeply concave substrates, which must extend beyond the edges of the wheel, may be accommodated for finishing.

As described above, the principle of operation of the variable-field permanent magnet magnetic system consists in redistribution of magnetic flux generated by permanent magnet 20 in a magnetic circuit including primary gap 18 and secondary gap 19. An actuator 118 is attached to allow rotation of the magnet and its axis of magnetization to the desired angle. A sensor 120 (e.g., positioning potentiometer, optical encoder, or the like) is provided to allow measurement of the magnet angle. Preferably, a Hall Effect sensor or some other appropriate probe (not shown) is installed in either primary gap 18 or secondary gap 19 to measure the magnetic flux density for control of actuator 118 through a conventional feed-back loop including sensor 120 through a conventional programmable control means (not shown) to set the desired field strength.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for magnetorheological finishing of a substrate, comprising:

a) a carrier wheel;

b) motor means for driving said carrier wheel;

c) first and second pole pieces disposed adjacent said carrier wheel and formed of a magnetically soft material defining jointly a magnetic body, said first and second pole pieces having a primary gap and a secondary gap formed between opposing ends thereof and having a cylindrical cavity formed in said magnetic body; and d) a cylindrical permanent magnet magnetized normally to a longitudinal axis thereof and rotatably disposed in said cylindrical cavity.

2. A system in accordance with claim 1 further comprising acutator means operationally connected to said cylindrical permanent magnet to cause selective rotation of said cylindrical permanent magnet about said axis to vary direction and intensity of magnetic flux within said first and second pole pieces and thereby to vary magnetic field intensity within said primary and secondary gaps.

3. A system in accordance with claim 2 further comprising:

a) first sensing means for determining the angular position of said cylindrical permanent magnet with respect to said primary and secondary gaps; and b) control means responsive to signals from said first sensing means and connected to said actuator.

4. A system in accordance with claim 1 further comprising second sensing means connected to said control means for determining magnetic field strength in at least one of said primary and secondary gaps.

5. A permanent magnet system for controllably varying the intensity of a magnetic field, comprising:

a) first and second pole pieces formed of a magnetically soft material defining jointly a magnetic body, said first and second pole pieces having a primary gap and a secondary gap formed between opposing ends thereof and having a cylindrical cavity formed in said magnetic body;

b) a cylindrical permanent magnet magnetized normally to a longitudinal axis thereof and rotatably disposed in said cylindrical cavity.

6. A permanent magnet system in accordance with claim 5 wherein said magnetically soft material is iron.

7. A permanent magnet system in accordance with claim 5 wherein said cylindrical permanent magnet is formed of a material including a rare earth element.

8. A permanent magnet system in accordance with claim 7 wherein said permanent magnet includes material selected from the group consisting of samarium, cobalt, neodymium, iron, boron, and a ceramic.

9. A permanent magnet system in accordance with claim 5 wherein the width of said secondary gap between said opposing ends of said pole pieces is at least equal to the width of said primary gap.

* * * * *